US010442570B1

(12) United States Patent
Gabriel

(10) Patent No.: US 10,442,570 B1
(45) Date of Patent: Oct. 15, 2019

(54) VOLUME-REDUCING CONTAINER SYSTEM AND METHOD

(71) Applicant: Gameel Gabriel, Covington, LA (US)

(72) Inventor: Gameel Gabriel, Covington, LA (US)

( * ) Notice: Subject to any disclaimer, the term of this patent is extended or adjusted under 35 U.S.C. 154(b) by 22 days.

(21) Appl. No.: 15/939,188

(22) Filed: Mar. 28, 2018

(51) Int. Cl.
*B65D 21/08* (2006.01)
*B65D 51/22* (2006.01)

(52) U.S. Cl.
CPC ..... *B65D 21/08* (2013.01); *B65D 51/228* (2013.01); *Y10T 83/04* (2015.04)

(58) Field of Classification Search
CPC .... B65D 51/222; B65D 51/20; B65D 51/228; B65D 2517/00; B65D 2517/0001; B65D 2517/001; B65D 90/38; B65D 21/08; B67B 7/30; B67B 7/34; B67B 7/36; Y10T 83/04
USPC .... 30/95–102, 107, 433, 436–442, 1.5, 278; 83/680; 82/70.2; 220/277, 278, 220/288–290, 669, 8, 258.4; 215/257; 285/40; 53/490
See application file for complete search history.

(56) References Cited

U.S. PATENT DOCUMENTS 1,464,167 A * 8/1923 Bergman ..... B67B 7/34 30/433
2,087,353 A * 7/1937 Mooney ..... B65D 21/08 220/293
2,648,128 A * 8/1953 Tanking, Jr. ..... B67B 7/34 30/435
2,765,944 A 10/1956 Davis
2,896,317 A * 7/1959 Vaive ..... B67B 7/30 30/1.5
3,266,658 A 8/1966 Meissner
3,456,346 A * 7/1969 Snyder ..... B26B 3/08 30/151
3,471,058 A * 10/1969 Latham ..... B65D 21/086 190/107
4,456,134 A 6/1984 Cooper
5,082,136 A * 1/1992 Schumann ..... B65D 51/228 215/228
5,240,130 A 8/1993 Osbakk
5,758,788 A 6/1998 Lifshey
6,598,755 B1 7/2003 Pedullà
6,662,964 B2 12/2003 Higuchi
6,669,040 B2 12/2003 Higuchi
7,513,378 B2 5/2009 Mori
2011/0017753 A1* 1/2011 Lewis ..... B65D 1/165 220/669

* cited by examiner

*Primary Examiner* — Laura M Lee
(74) *Attorney, Agent, or Firm* — Keaty Law Firm LLC

(57) ABSTRACT

A volume-reducing container system and method for reducing empty air space within the container as the contents are removed, providing a spiral-grooved container body with a continuous downward spiraling groove along a cylindrical side surface, and providing a cutting cap to seal the container body, and having mounted inside a reducing cutter to follow and cut through the continuous downward spiraling groove when the cutting cap is turned in a nominally clockwise direction, yielding a smaller container and a tail of removed material, a tail channel within the cutting cap to allow passage of the tail of removed material out of the cutting cap, and a tail-trimming cutter which moves away from the tail of removed material during clockwise rotation of the cutting cap, and moves into and cuts the tail of removed material when the cutting cap is rotated counterclockwise.

20 Claims, 7 Drawing Sheets

VOLUME-REDUCING CONTAINER SYSTEM AND METHOD

BACKGROUND

This invention provides a volume-reducing container system and method for reducing empty air space within the container as the contents are removed.

Under many circumstances it is undesirable to have empty air space inside a container from which the contents have been partially removed. For instance, the contents might be subject to some sort of spoilage from the air in the empty space. Also, where storage space for the container itself is limited, it might be undesirable to give space to empty air. Moreover, some contents require dark or opaque containers in order to avoid degradation by light. But such lightproof containers make it difficult to see, with a visual inspection, how much of the contents are still on hand and unused. In such a case, it would be beneficial to reduce the volume of the container itself to correspond to the volume of the remaining contents.

The prior art does not provide for a volume-reducing container system and method of the present invention for reducing empty air space within the container as the contents are removed.

For example, U.S. Pat. No. 4,456,134 was issued on Jun. 26, 1984 to inventor Leonard Cooper, disclosing an "Apparatus for Containment of Carbonated Beverages." The '134 Patent discloses an apparatus for the containment of carbonated beverages, and the like, and more particularly to a "variable volume" container for such beverages that intends to maintain high levels of carbonation in a partially filled container. Here, the container is comprised of a top member with an opening for filling and pouring in the conventional manner and a bottom member, which are both integrally connected by a flexible compressible or collapsible midsection. Means are also provided for externally connecting between the top and bottom member of the container, which external means operate to alter and maintain the internal volume of the container. Progressive adjustments in internal volume are possible.

U.S. Pat. No. 7,513,378 issued on Apr. 7, 2009 to assignee Akihide Mori for an "Extendable Container." The '378 Patent provides for an extendable container, specifically an extendable container comprising a container body including a bottom part, a bellows barrel part extendable in a height direction (i.e., is foldable and extendable), and a top part having an openable cover, and a sheet, said sheet wrapped around an outer circumference of the container body to secure the container body, wherein the bellows barrel part includes ring portions, each having a predetermined width and trough portions, the ring portions including projections arranged thereon, and wherein the sheet includes locking holes at positions in alignment with the projections of the ring portions so that the locking holes receive the respective projections when the sheet is wrapped around the bellows barrel part.

U.S. Pat. No. 5,240,130, titled "Compressible Bottle," issued to inventor Georg Osbakk on Aug. 31, 1993, and relates to a compressible bottle made of plastics that may easily compress in order to reduce garbage volume. Here, the compressible body comprises of a container and a flexible annular wall member, and the container, in turn, includes a cylindrical side wall and a prestressed locking member. The side wall of the container forms an upper edge and defines a cylindrical space having a given circumference, and the locking member of the container is mounted on the upper edge of the side wall and is inherently biased radially inwardly toward a position inward of that given circumference. The wall member of the bottle is mounted inside the container of the bottle, and that wall member has extended and compressed positions. In the extended position, the wall member extends upward from the container; and in the compressed position, the wall member is at least substantially contained within the container and the upper portion of the wall member is below the locking member of the container. Moreover, when the wall member is compressed into its compressed position, the locking member moves radially inwardly, due to is inherent resiliency, to a locking position in which the locking member extends directly over the upper portion of the wall member and locks that wall member inside the container.

U.S. Pat. No. 6,598,755, as issued to inventors Christian Pio Pedullà and Gianfilippo Pagliacci on Jul. 29, 2003, covers an invention entitled "Disposable Bottle Having a Gradually Collapsible, Recovery-Free, Structure of its Side-Walls." Specifically disclosed is a disposable bottle, having a gradually collapsible structure, of the type in which the sidewalls of the bottle have an accordion-like structure comprising several adjacent folds. Each fold is formed by two opposed surfaces of different width, comprising blocking means to prevent the recovery of the fold, under a predetermined force, once the same fold has collapsed for the first time. That is, the provided disposable bottle's accordion-like sidewalls can be collapsed step-by-step as the internal content of the bottle is used up, so as to maintain practically constant the volume of air at the top of the bottle. At the same time, the volume of the bottle is reduced in proportion to its actual content, saving space in the places wherein the bottle or container is stored. Finally, when the content of the bottle is completely used up, the bottle has reached its minimum volume and can therefore be directly thrown away, without any further compacting operation, as is usually required for empty containers so as to reduce the bulkiness of the rubbish.

U.S. Pat. No. 6,662,964 for a "Synthetic Resin Liquid Container" was issued on Dec. 16, 2003 to assignee Gohsho Company, Ltd. Inventor Mitsuo Higuchi conceptualized a synthetic resin liquid container for containing drinking water, juice, milk and other liquids. The body of the synthetic resin liquid container can substantially reduce its volume when a vertical and/or twisting stress is applied to the body. That is, the body of the bottle may substantially reduce its volume when it is empty. Further provided is a form-retaining means that is to be used after compression of the container body for keeping it compressed.

U.S. Pat. No. 6,669,040 for a "Container Capable of Maintaining its Compressed State in a Longitudinal Direction and Compression Method Thereof" issued to assignee Gosho Company, Limited on Dec. 30, 2003. Here, Inventor Mitsuo Higuchi also conceptualized a container body of which length in the longitudinal direction or a part thereof is formed into horizontal accordion shape except the tap portion, wherein a force in one direction acts on a piece of folds constituting the accordion shape and/or a part of inner periphery, while a force in the opposite direction acts on the outer periphery thereof, when a force from a substantially right-angle direction thereof is applied to the accordion-shaped portion of said container body, thereby a compressed state in a longitudinal direction is maintained.

U.S. Pat. No. 2,765,944, as issued to inventor Clenon J. Davis on Oct. 9, 1956, discloses a "Bottle Cap and Seal Cutter." This disclosed invention relates to a bottle cap that is provided with a means to expeditiously and safely cut, at a point immediately below the cap, the usual plastic seal used on many bottles. The '944 Patent claimed the combination with a bottle comprising a threaded neck including a shoulder, a screw cap comprising a skirt threaded on the neck and spaced from the shoulder, and a severable seal bridging the shoulder and the skirt, of a cutter comprising a horizontal arm pivotally secured centrally on the cap and including a resilient, depending free end portion operable about the skirt and terminating in an inturned blade insertable between the shoulder and the skirt for penetrating and cutting the seal, and a pair of spaced, opposed grips projecting from said depending end portion of said arm for actuating the cutter.

U.S. Pat. No. 5,758,788 for a "Piercing Container Cap," as issued on Jun. 2, 1998 to assignee Merck & Co., Inc., relates to a container cap that contains a piercing member. The cap being designed to move first downward and then upward relative to the container to which it is affixed, when it is first rotated in the direction expected to result in removal of the cap. The downward motion allows the piercing member to contact a seal or cover on the container, thereby causing the seal or cover to rupture. The subsequent upward motion allows for removal of the cap.

Lastly, U.S. Pat. No. 3,266,658 covers "Molded Containers," as issued to assignee FMC Corporation on Aug. 16, 1966. Inventor William E. Meissner contemplated a molded container with the primary object of providing an improved molded plastic container with an attached means of opening the container.

What is needed is the volume-reducing container system and method of the present invention for reducing empty air space within the container as the contents are removed.

SUMMARY OF THE INVENTION

This invention provides a volume-reducing container system and method for reducing empty air space within the container as the contents are removed, providing a spiral-grooved container body with a continuous downward spiraling groove along a cylindrical side surface, and providing a cutting cap to seal the container body, and having mounted inside a reducing cutter to follow and cut through the continuous downward spiraling groove when the cutting cap is turned in a nominally clockwise direction, yielding a smaller container and a tail of removed material, a tail channel within the cutting cap to allow passage of the tail of removed material out of the cutting cap, and a tail-trimming cutter which moves away from the tail of removed material during clockwise rotation of the cutting cap, and moves into and cuts the tail of removed material when the cutting cap is rotated counterclockwise.

BRIEF DESCRIPTION OF DRAWINGS

Reference will now be made to the drawings, wherein like parts are designated by like numerals, and wherein.

DETAILED DESCRIPTION OF THE INVENTION

Figure 1:
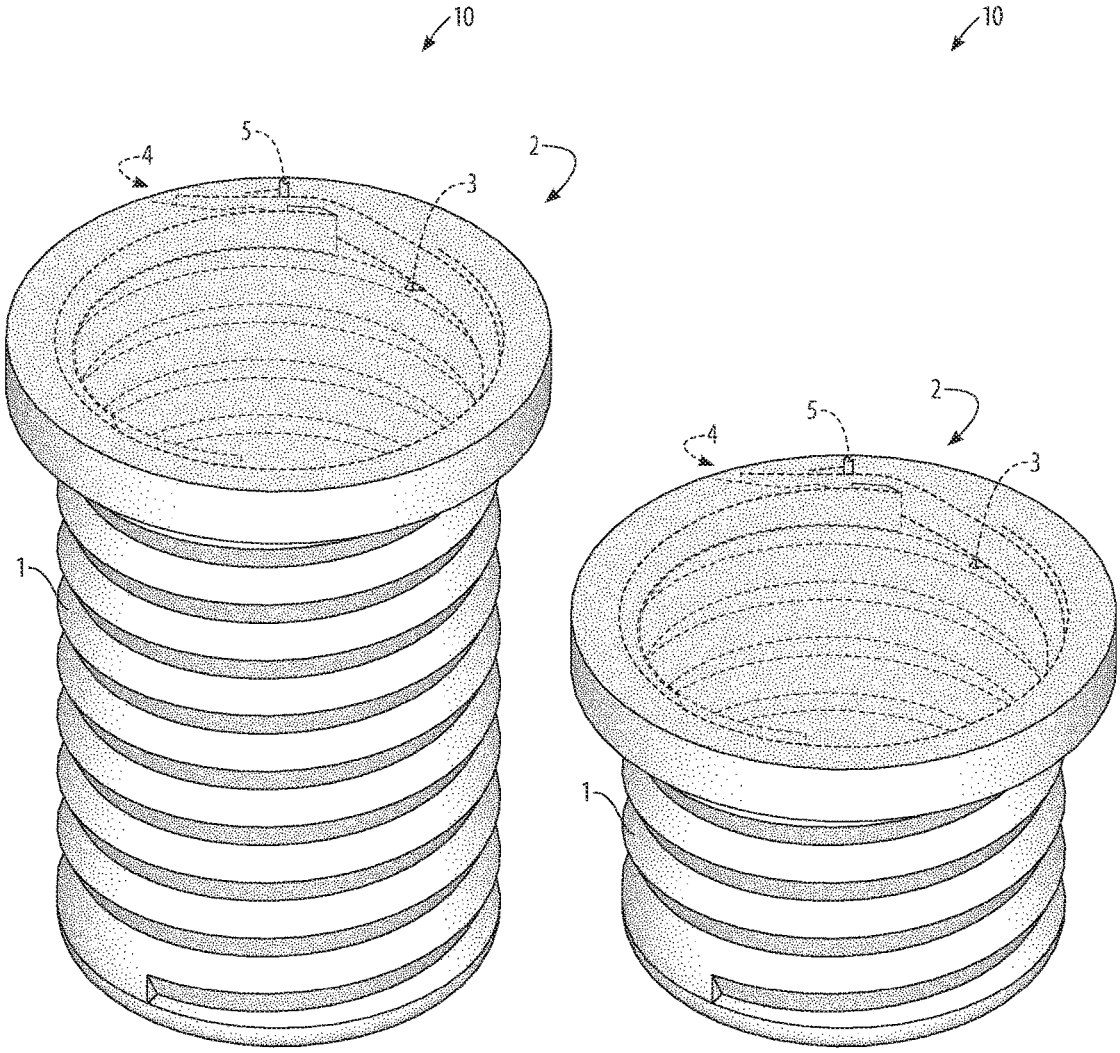
FIG. 1 is a perspective view of the volume-reducing container of the invention in two states of being reduced in use.

Referring to FIG. 1, as well as all of the figures generally, the volume-reducing container of the invention is shown. As illustrated, the cylindrical sides of the container can be cut away in increments corresponding to the volume of contents which are removed, reducing the volume of the container to correspond to the volume of remaining contents.

The volume-reducing container 10 provides a spiral-grooved container body 1 and a cutting cap 2. The spiral groove is formed as a continuous downward spiraling groove. By convention, tightening the cap is achieved by clockwise rotation and loosening the cap is achieved by counterclockwise rotation. The spiral groove runs downward in a clockwise or tightening direction.

The spiral-grooved container body 1 can be constructed out of a plastic or a coated paper or cardboard material. High-density polyethylene (HDPE) is a suitable material. The material should yield cut edges that are not dangerously sharp.

The cutting cap 2 can be constructed from a material having enough stiffness to form and hold a spiraling thread and a void channel, and to securely hold a fixed and a moving cutting blade. A plastic such as polypropylene (PP) is a suitable material.

Figure 2:
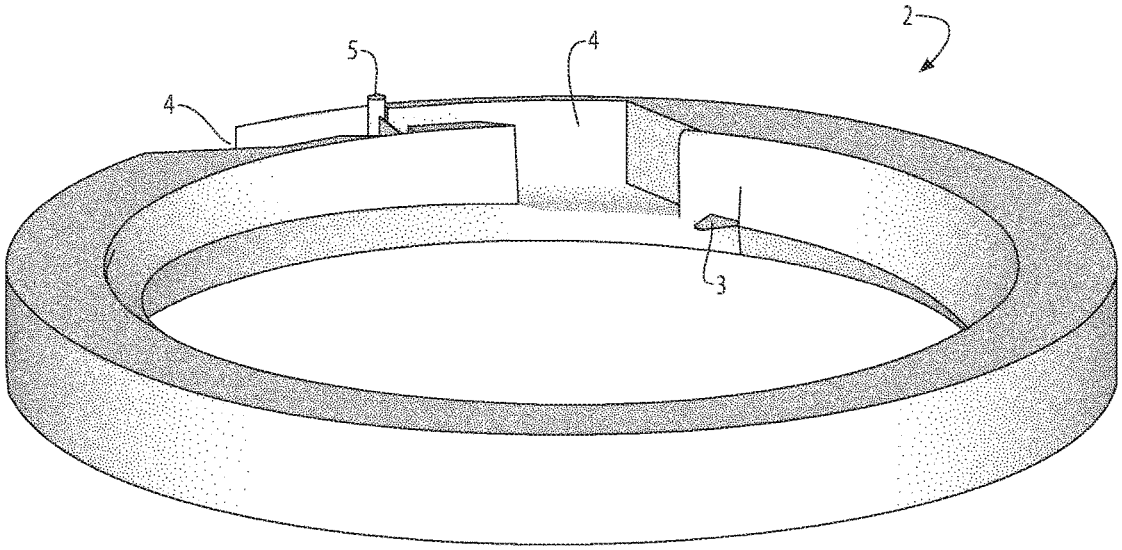
FIG. 2 is a perspective detail view of the cutting cap of the volume-reducing container of the invention.
Figure 3:
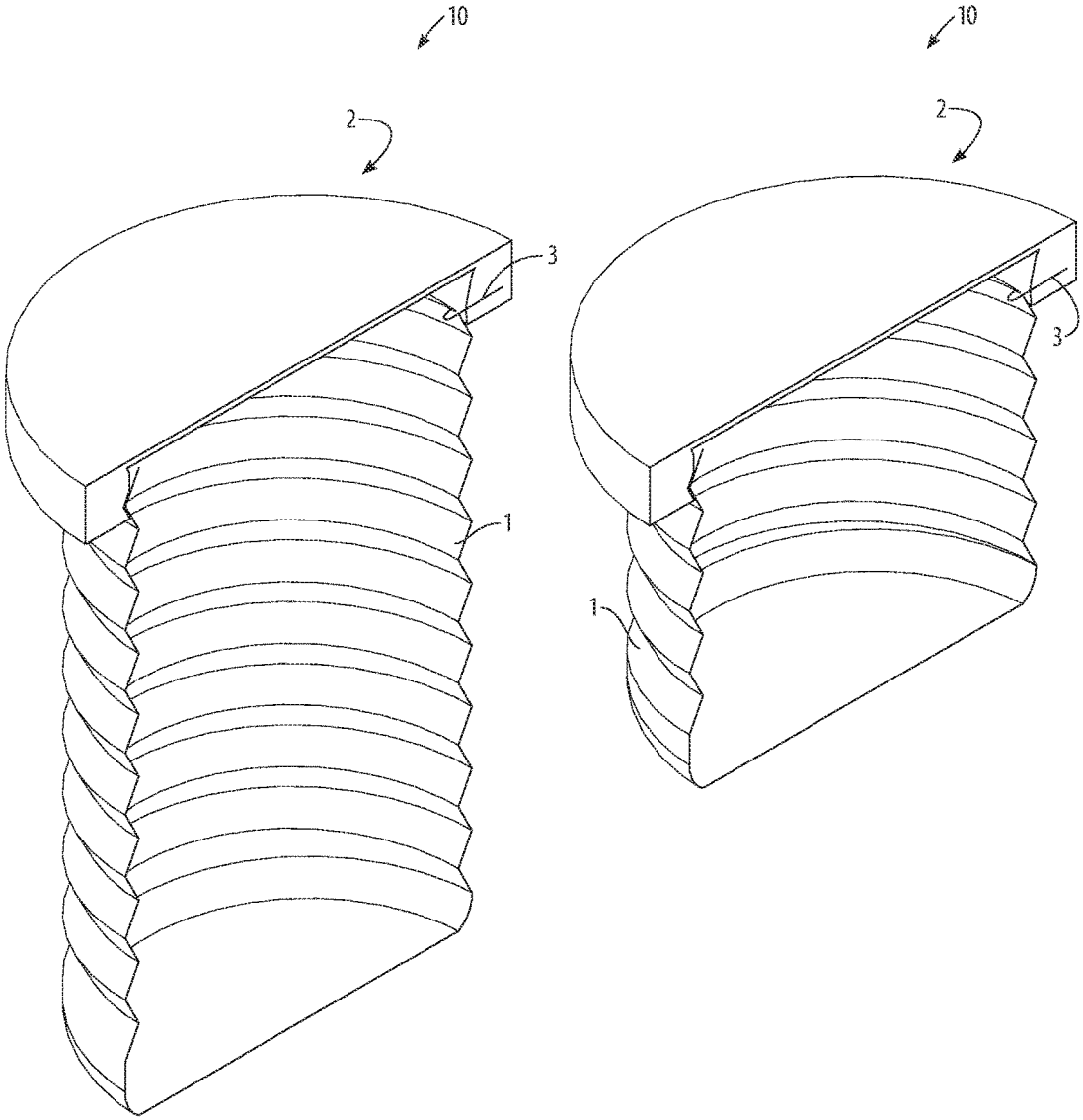
FIG. 3 is a perspective section view of the volume-reducing container of the invention in two states of being reduced in use.

Referring additionally to FIG. 2, the cutting cap 2 has an internal spiraling thread corresponding to the spiraling groove of the spiral-grooved container body 1, such that rotating of the cap causes a tightening or loosening of the cap. The cutting cap 2 provides a reducing cutter 3 mounted inside the cap such that it follows the clockwise downward spiraling groove of the spiral-grooved container body 1 and cuts through the container body. FIG. 3 illustrates the placement of the reducing cutter 3 corresponding to the continuous downward spiraling groove of the spiral-grooved container body 1.

The cutting cap 2 provides a tail channel 4 void space through to the outside of the cap. The tail of container-body material which is cut away by the reducing cutter 3 will pass through the tail channel and out of the cutting cap 2.

The cutting cap 2 also provides a tail-trimming cutter 5, the operation of which will be treated below.

Figure 4:
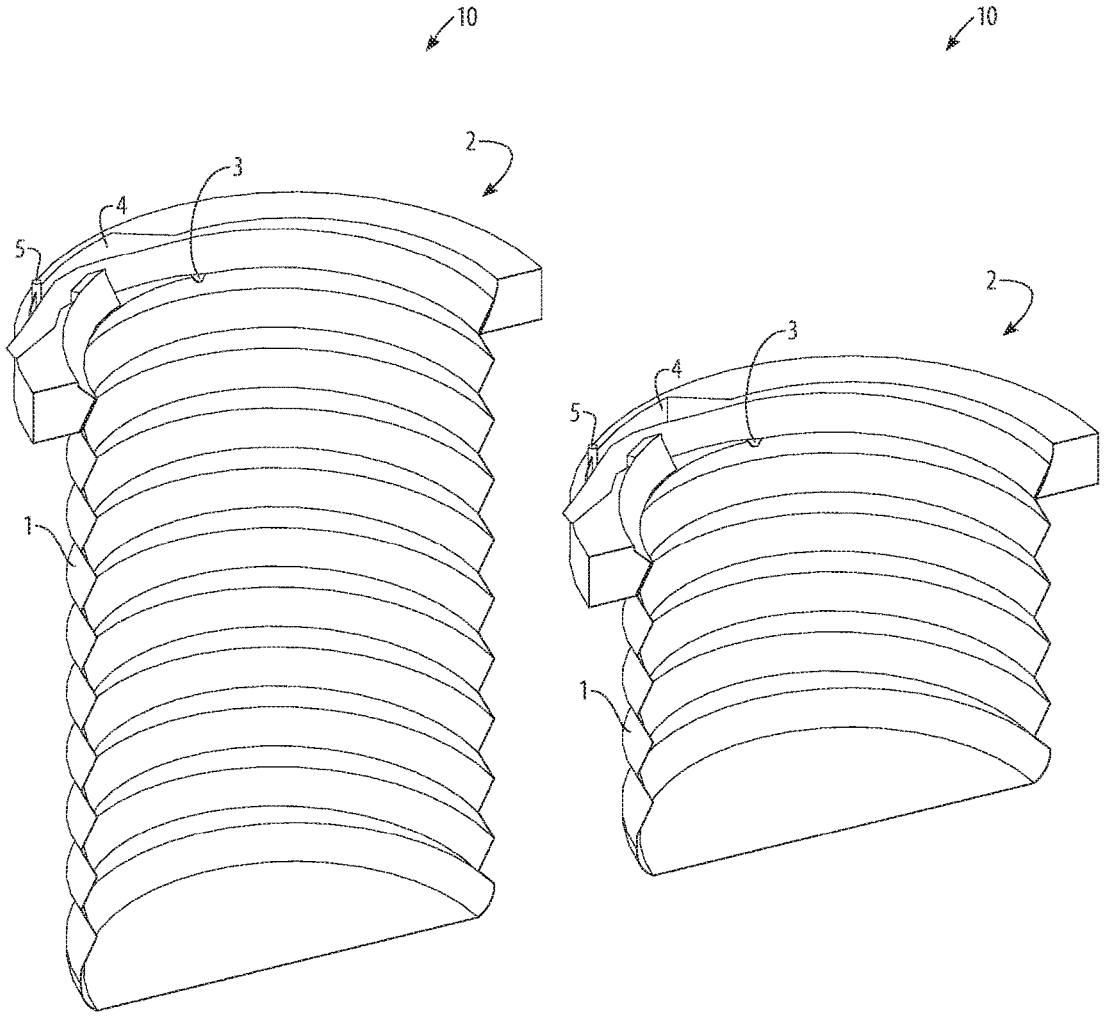
FIG. 4 is a perspective section view of the volume-reducing container of the invention in two states of being reduced in use.

Referring to FIG. 4, in use, at rest, the cutting cap 2 will be tightened to the spiral-grooved container body 1 and the container will be closed or sealed. The reducing cutter 3 will be resting against the end of the uncut portion of the spiral groove, which will be considered to be an initial location. The cutting cap 2 can be loosened and removed from the spiral-grooved container body 1 by counterclockwise rotation, and part of the contents of the container can be removed. When the cutting cap 2 is replaced, the reducing cutter 3 will encounter resistance by the uncut portion of the spiral groove at the nominal initial location. Further clockwise rotation of the cutting cap 2 causes the reducing cutter 3 to cut through the spiral groove. The resulting tail of removed material will move into the tail channel 4 of the cutting cap 2, and move toward the outside of the cap. The cutting cap 2 does not rest upon the portion of the spiral-grooved container body 1 which has been cut away. As the clockwise rotating progresses, the overall height, and therefore volume, of the container will be reduced, eliminating empty space that would otherwise be left over from the partial removal of contents.

Figure 5:
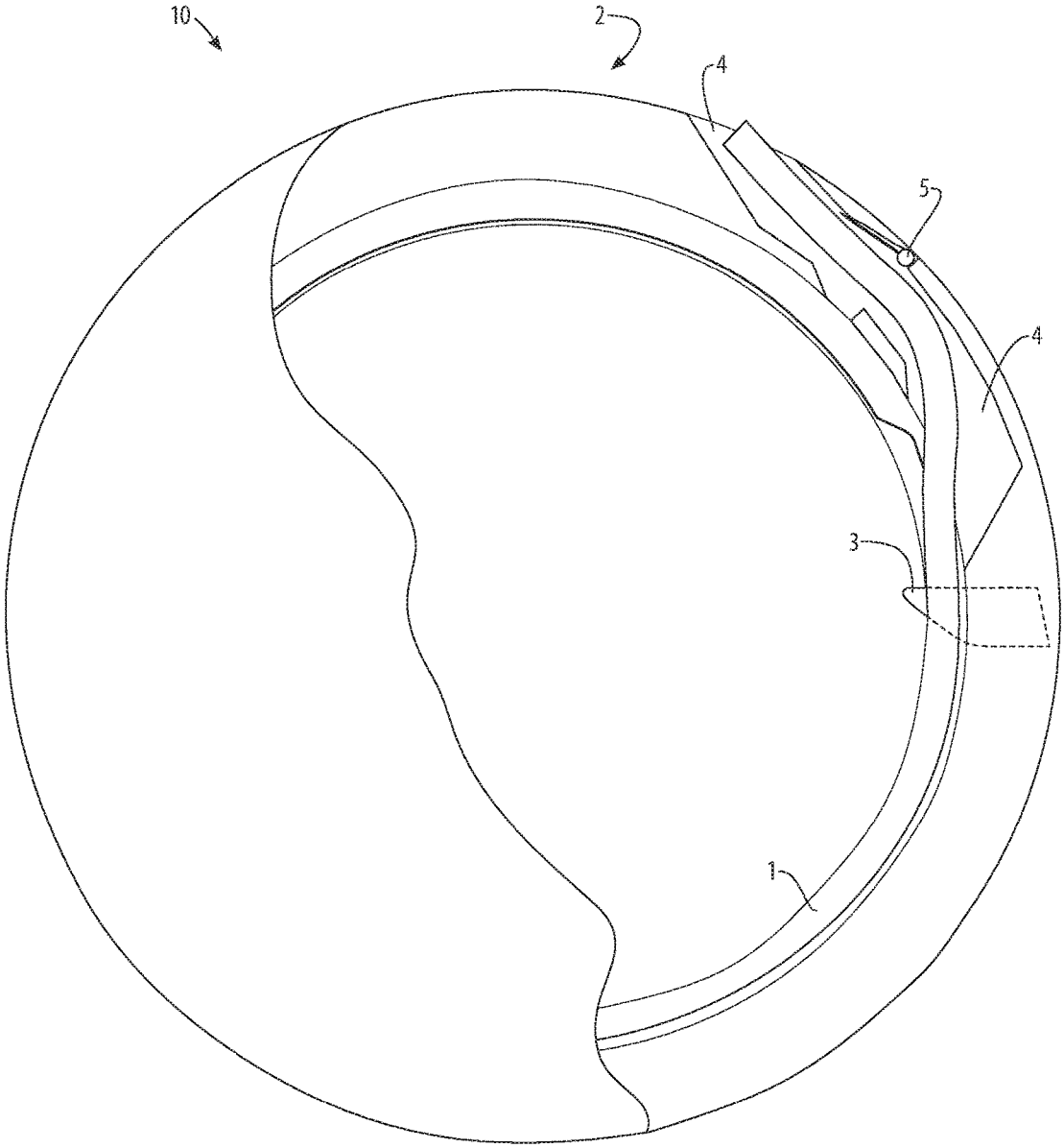
FIG. 5 is a partially cutaway plan view of the volume-reducing container of the invention in use with the tail-trimming cutter disengaged.
Figure 6:
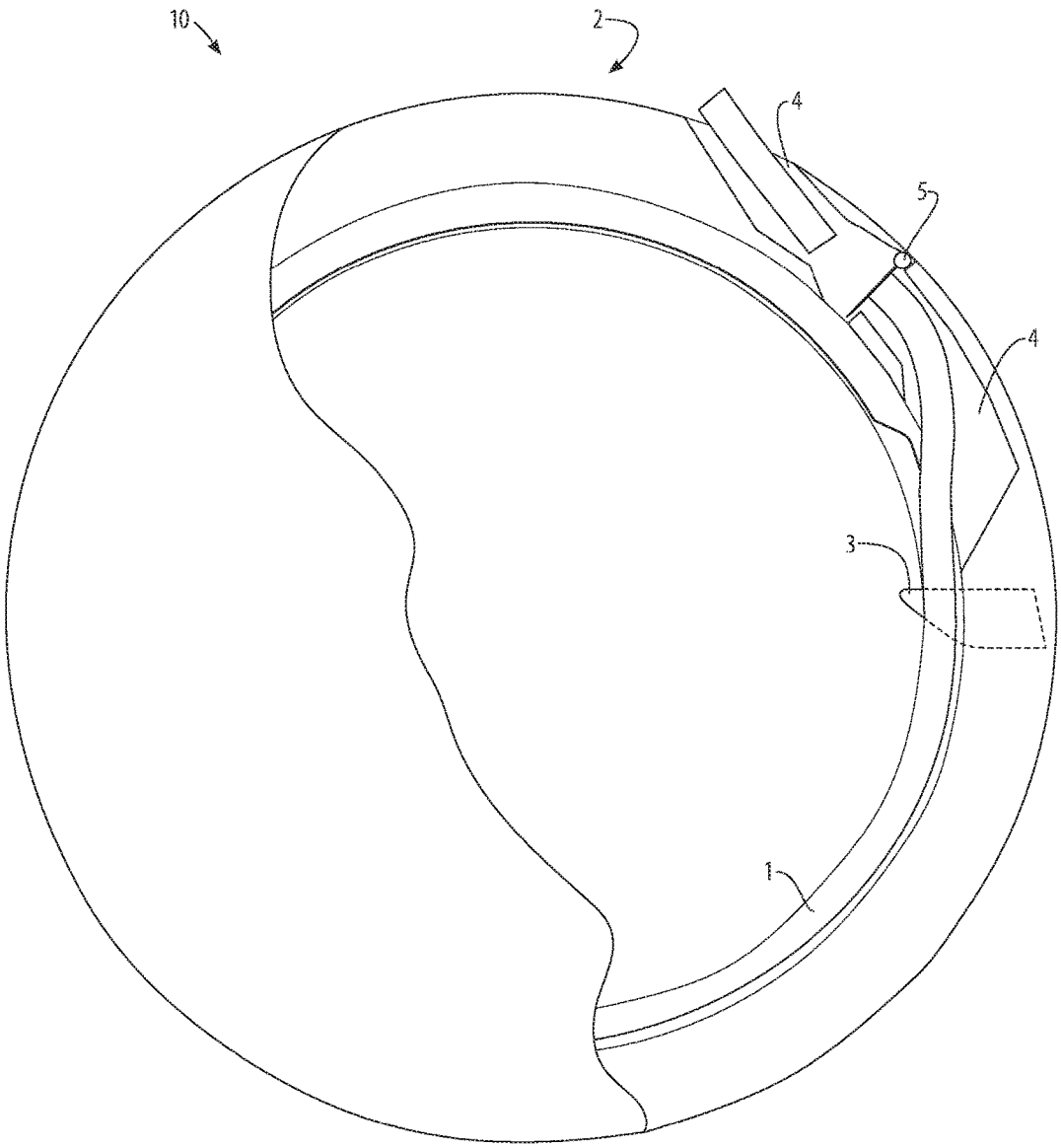
FIG. 6 is a partially cutaway plan view of the volume-reducing container of the invention in use with the tail-trimming cutter engaged.

Referring to FIG. 5 and FIG. 6, a tail-trimming cutter 5 is provided within the cutting cap 2 for the purpose of cutting or trimming off the tail of removed material. In the illustrated embodiment, the blade of the tail-trimming cutter 5 is mounted on a pivot such that when the cutting cap 2 is being rotated clockwise, the blade is away from cutting contact with the tail of removed material. When the cutting cap 2 is rotated counterclockwise, the tail-trimming cutter 5 pivots into a different position and cuts through the tail of removed material.

Figure 7:
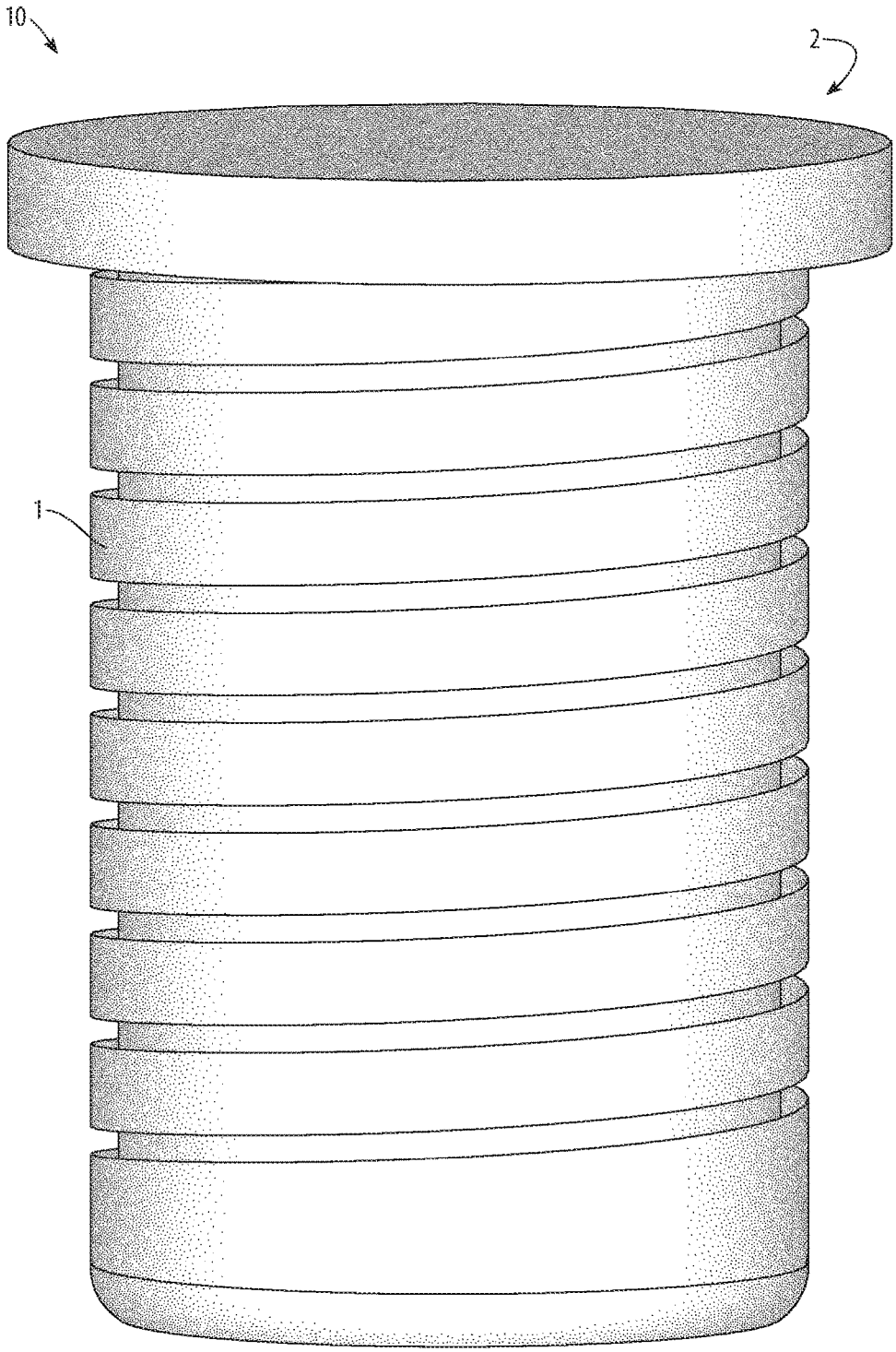
FIG. 7 is a perspective view of an embodiment of the volume-reducing container of the invention having smooth grooved sides.

Referring to FIG. 7, the grooved sides of the spiral-grooved container body can be made to present a smooth grooved profile, as illustrated. With such a smooth profile, it is important that the grooves be made deep enough to provide a sufficient surface for the cutting cap to be securely attached and rotated.

Many other changes and modifications can be made in the system and method of the present invention without departing from the spirit thereof. I therefore pray that my rights to the present invention be limited only by the scope of the appended claims.

I claim:

1. A volume-reducing container for reducing empty air space within the container as the contents are removed, having a nominally clockwise direction for sealing and counterclockwise direction for opening, the volume-reducing container comprising:

(i) a spiral-grooved container body of substantially cylindrical shape, with sides and a bottom and an open top, providing a continuous downward spiraling groove along the cylindrical side surface having a clockwise direction;

(ii) a cutting cap adapted to fit upon and seal the open top of said spiral-grooved container body;

(iii) a reducing cutter mounted inside said cutting cap, adapted to follow and cut through the continuous downward spiraling groove of said spiral-grooved container body when turned in a clockwise direction, yielding a smaller container and a tail of removed material;

(iv) a tail channel formed within said cutting cap adapted to allow passage of the tail of removed material out of said cutting cap; and (v) a tail-trimming cutter within said tail channel adapted to move away from the tail of removed material during clockwise rotation of said cutting cap, and to move into and cut the tail of removed material when said cutting cap is rotated counterclockwise;

where, in use, as contents are removed from said volume-reducing container, said cutting cap is rotated clockwise such that said reducing cutter moves past an initial location on the continuous downward spiraling groove of said spiral-grooved container body, and makes a further cut into the groove, yielding a smaller container and a tail of removed material, which follows said tail channel toward exiting said cutting cap; and where, in use, upon counterclockwise rotation of said cutting cap said tail-trimming cutter moves into contact with, and cuts the tail of removed material.

2. The volume-reducing container of claim 1, where said reducing cutter further comprises a blade.

3. The volume-reducing container of claim 1, where said reducing cutter further comprises a steel blade.

4. The volume-reducing container of claim 1, where said reducing cutter further comprises a ceramic blade.

5. The volume-reducing container of claim 1, where said tail-trimming cutter further comprises a pivoting blade.

6. The volume-reducing container of claim 1, where said tail-trimming cutter further comprises a cam-driven blade.

7. The volume-reducing container of claim 1, wherein a non-groove portion of the exterior surface of said spiral-grooved container body extends outward to form a substantially zig-zag profile.

8. The volume-reducing container of claim 1, where a non-grooved portion of the exterior surface of said spiral grooved container body does not extend outward, thereby forming a substantially flat profile exclusive of the grooves.

9. The volume-reducing container of claim 1, where said spiral-grooved container body is made from a plastic material.

10. The volume-reducing container of claim 1, where said cutting cap is made from a plastic material.

11. A volume-reducing container method for reducing empty air space within the container as the contents are removed, comprising:

(i) providing a volume-reducing container apparatus, further comprising:

(a) a spiral-grooved container body of substantially cylindrical shape, with sides and a bottom and an open top, providing a continuous downward spiraling groove along the cylindrical side surface having a clockwise direction;

(b) a cutting cap adapted to fit upon and seal the open top of said spiral-grooved container body;

(c) a reducing cutter mounted inside said cutting cap, adapted to follow and cut through the continuous downward spiraling groove of said spiral-grooved container body when turned in a clockwise direction, yielding a smaller container and a tail of removed material;

(d) a tail channel formed within said cutting cap adapted to allow passage of the tail of removed material out of said cutting cap; and (e) a tail-trimming cutter within said tail channel adapted to move away from the tail of removed material during clockwise rotation of said cutting cap, and to move into and cut the tail of removed material when said cutting cap is rotated counterclockwise; and (ii) using said volume-reducing container apparatus such that, as contents are removed from said volume-reducing container apparatus, said cutting cap is rotated clockwise such that said reducing cutter moves past an initial location on the continuous downward spiraling groove of said spiral-grooved container body, and makes a further cut into the groove, yielding a smaller container and a tail of removed material, which follows said tail channel toward exiting said cutting cap; and upon counterclockwise rotation of said cutting cap said tail-trimming cutter moves into contact with, and cuts the tail of removed material.

12. The volume-reducing container method of claim 11, where said reducing cutter further comprises a blade.

13. The volume-reducing container method of claim 11, where said reducing cutter further comprises a steel blade.

14. The volume-reducing container method of claim 11, where said reducing cutter further comprises a ceramic blade.

15. The volume-reducing container method of claim 11, where said tail-trimming cutter further comprises a pivoting blade.

16. The volume-reducing container method of claim 11, where said tail-trimming cutter further comprises a cam-driven blade.

17. The volume-reducing container method of claim 11, wherein a non-groove portion of the exterior surface of said spiral-grooved container body extends outward to form a substantially zig-zag profile.

18. The volume-reducing container method of claim 11, where a non-grooved portion of the exterior surface of said spiral grooved container body does not extend outward, thereby forming a substantially flat profile exclusive of the grooves.

19. The volume-reducing container method of claim 11, where said spiral-grooved container body is made from a plastic material.

20. The volume-reducing container method of claim 11, where said cutting cap is made from a plastic material.

* * * * *